US008950325B2

(12) United States Patent
Niemiro et al.

(10) Patent No.: US 8,950,325 B2
(45) Date of Patent: Feb. 10, 2015

(54) PRESS INKING SYSTEM WITH KEY SHARING PROVISION

(75) Inventors: Thaddeus A. Niemiro, Lisle, IL (US); Daniel F. Machaj, Romeoville, IL (US); Thomas W. Orzechowski, Carol Stream, IL (US); Joseph Vucko, Lemo, IL (US); Albert L. Van Wieren, Dyer, IN (US)

(73) Assignee: Goss International Corporation, Durham, NH (US)

( * ) Notice: Subject to any disclaimer, the term of this patent is extended or adjusted under 35 U.S.C. 154(b) by 430 days.

(21) Appl. No.: 12/855,248

(22) Filed: Aug. 12, 2010

(65) Prior Publication Data

US 2012/0038717 A1 Feb. 16, 2012

(51) Int. Cl.

| | |
|---|---|
| ***B41F 31/08*** | (2006.01) |
| ***B41F 31/02*** | (2006.01) |
| ***B41J 2/175*** | (2006.01) |
| ***B41J 29/02*** | (2006.01) |

(52) U.S. Cl.

CPC ..... *B41F 31/027* (2013.01); *B41F 31/08* (2013.01); *B41J 2/175* (2013.01); *B41J 29/02* (2013.01)

USPC ..... 101/365; 101/366

(58) Field of Classification Search

CPC ..... B41F 31/027; B41F 31/08

USPC ..... 101/366, 365, 364, 205; 137/625.69

See application file for complete search history.

(56) References Cited

U.S. PATENT DOCUMENTS

| | | | | |
|---|---|---|---|---|
| 3,202,170 | A * | 8/1965 | Holbrook | 137/269 |
| 4,667,323 | A | 5/1987 | Engdahl et al. | |
| 5,027,706 | A | 7/1991 | Niemiro et al. | |
| 5,472,324 | A | 12/1995 | Atwater | |
| 5,482,448 | A | 1/1996 | Atwater et al. | |
| 5,575,311 | A | 11/1996 | Kingsford | |
| 5,957,051 | A | 9/1999 | Atwater | |
| 6,513,430 | B1 | 2/2003 | Atwater | |
| 6,810,805 | B1 | 11/2004 | Atwater | |
| 7,007,604 | B2 | 3/2006 | Momot | |
| 7,171,899 | B2 * | 2/2007 | Momot | 101/366 |
| 7,458,561 | B2 * | 12/2008 | Oishi | 251/337 |
| 2007/0079714 | A1 | 4/2007 | Atwater | |

OTHER PUBLICATIONS

Versa Valves Series V-316 catalog, bulletin V316-2007, published 2007.*

* cited by examiner

*Primary Examiner* — Daniel J Colilla
*Assistant Examiner* — Leo T Hinze
(74) *Attorney, Agent, or Firm* — Marshall, Gerstein & Borun LLP

(57) ABSTRACT

Disclosed herein is an ink rail assembly having a key sharing provision. The ink rail assembly includes a page pack having an ink inlet for receiving ink from an ink source and an ink outlet; and an ink rail fluidly coupled to the page pack ink outlet. The ink rail includes at least two ink keys for delivering ink to a drum of a printing press, and a diverter assembly in fluid communication with the at least two ink keys and to the page pack to control the flow of ink from the page pack and selective divert the flow of ink between the at least two ink keys.

23 Claims, 9 Drawing Sheets

PRESS INKING SYSTEM WITH KEY SHARING PROVISION

FIELD OF THE DISCLOSURE

The present disclosure relates to printing presses, and more particularly, to a press inking system with key sharing capabilities.

BACKGROUND OF THE INVENTION

In a conventional lithographic printing press, ink or an ink emulsion is supplied to a high speed or slow speed drum using an ink supply system. As is known in the art, the ink is typically transferred to a plate cylinder via a number of intermediate drums or cylinders. Typically, a printing press includes a number of ink rail assemblies, with at least one ink rail assembly for each high speed or slow speed ink supply drum. Thus, the ink may be supplied to each of the ink rail assemblies through a system of supply lines and/or headers. The ink supply system generally includes a pump, a supply line, and a control valve. The ink supply system supplies ink under controlled pressure to an ink rail assembly, which is mounted closely adjacent to the high speed or slow speed ink supply drum. The ink rail assembly generally includes an ink rail having a number of orifices or ink keys spread out along its length. Thus, ink is supplied to the ink keys of the ink rail, from which the ink is applied directly to the surface of the high speed or slow speed drum.

In general, ink flow control is effected by ink pulses of variable duration corresponding to the printing density requirement of a given printed column. Accordingly, the ink supply system includes a cycling mechanism that turns the ink supply "on" for a period of time and "off" for a period of time. One cycling mechanism is dedicated to one inking column. As shown in FIG. 1, a conventional ink rail assembly 10 includes an ink rail 12 with ink keys 14 evenly spaced along the ink rail 12 and one or more ink metering assemblies, for example, page packs 16. The page packs 16 are in fluid communication with the ink keys 14. Each ink key 14 is fluidly coupled to a dedicated ink supply outlet (not shown) on the page pack 16. Only one ink key 14 is supplied by each ink supply outlet on the page pack 16. For example, in order to supply 20 ink keys, two page packs each having 10 supply outlets would be required. The cycling mechanism can be a valve disposed near the ink outlet of the page pack. The valve is moveable between an open and closed position to control the flow of ink into the ink rail 12.

SUMMARY OF THE INVENTION

An ink rail assembly in accordance with an aspect of the present disclosure includes a page pack including a page pack ink inlet in fluid communication with an ink source and a page pack ink outlet in fluid communication with the page pack ink inlet, an ink rail having at least two ink keys fluidly coupled to the page pack ink outlet, and a diverter assembly in fluid communication with the page pack ink outlet and the at least two keys. The diverter assembly selectively diverts the flow of ink from the page pack ink outlet between the at least two ink keys.

In one embodiment, the diverter assembly includes first and second conduits and is adapted to shift between a first position in which the first conduit fluidly couples the pack page ink outlet and one of the at least two ink keys and a second position in which the second conduit fluidly couples the page pack ink outlet and the other one of the at least two ink keys to selectively divert the flow of ink from the page pack ink outlet between the at least two ink keys. The diverter assembly can be shifted between the first and second positions by an electrical or pneumatic means.

In another embodiment, the diverter assembly includes diverter valves to selectively divert the flow of ink from the page pack ink outlet between the at least two ink keys.

In one embodiment, the diverter valve is a diverter spool valve, which includes a diverter valve ink inlet and at least two diverter valve ink outlets, a diaphragm moveable in response to a change in pressure, and a poppet assembly operatively coupled to the diaphragm and moveable in response to movement of the diaphragm. The poppet assembly diverts a flow of ink to one of the diverter valve ink outlets. For example, the diverter spool valve can include first and second diverter valve ink outlets. When the diaphragm is in a first open position, the diverter spool valve diverts the flow of ink to the first diverter valve ink outlet. When a first pressure is applied to the diverter valve, the diaphragm moves away from the first open position to a second open position in which the flow of ink is diverted to the second diverter valve ink outlet. When a second pressure is applied to the diverter valve, the diaphragm moves away from the second open position to a closed position, which prevents the flow of ink to either diverter valve ink outlet.

In another embodiment, the page pack can include a plurality of ink outlets. The ink rail can also include a plurality of ink keys. The ratio of ink outlets of the page pack to ink keys can be, for example, about 1:2.

In yet another embodiment, the ink rail assembly can further include a manifold having an ink inlet face and an ink outlet face. The page pack can be operatively coupled to the ink inlet face of the manifold, and the ink rail can be operatively coupled to the ink outlet face of the manifold. The page pack, the manifold, and the ink rail are in fluid communication.

A printing press having an ink rail assembly in accordance with the present disclosure includes a frame, a drum mounted to the frame for receiving and transferring ink, and an ink rail assembly configured to deliver ink to the drum. The ink rail assembly includes a page pack including a page pack ink inlet in fluid communication with an ink source and a page pack ink outlet in fluid communication with the page pack ink inlet, an ink rail comprising at least two ink keys fluidly coupled to the page pack ink outlet, and a diverter assembly in fluid communication with the page pack ink outlet and the at least two keys. The diverter assembly selectively diverts the flow of ink from the page pack ink outlet between the at least two ink keys.

In one embodiment, the printing press includes an ink rail assembly that further includes a manifold mounted to the frame. The page pack of the ink rail assembly is mounted to an ink inlet face of the manifold, and the ink rail is mounted to an ink outlet face of the manifold. The page pack, manifold, and ink rail are in fluid communication.

An ink rail in accordance with the present disclosure includes an ink inlet, at least two ink keys in fluid communication with the ink inlet, and at least two conduits each extending between the ink inlet and one of the at least two ink keys.

DETAILED DESCRIPTION OF THE DISCLOSURE

Although the following text sets forth a detailed description of one or more exemplary embodiments of the invention, it should be understood that the legal scope of the invention is defined by the words of the appended claims. The detailed description is to be construed as exemplary only and does not describe every possible embodiment or embodiments of the invention because describing every possible embodiment would be impractical, if not impossible. Numerous alternative embodiments could be implemented using either current technology or technology developed after the filing date of this patent, all of which would still fall within the scope of the claims defining the invention.

Figure 1:
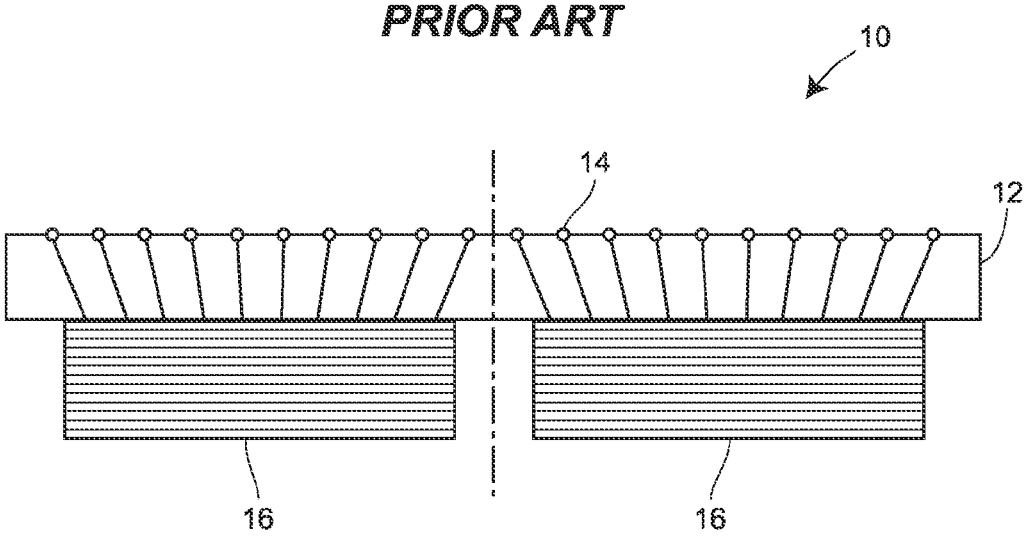
FIG. 1 PRIOR ART
FIG. 1 is a schematic representation of a conventional ink rail assembly.
Figure 2:
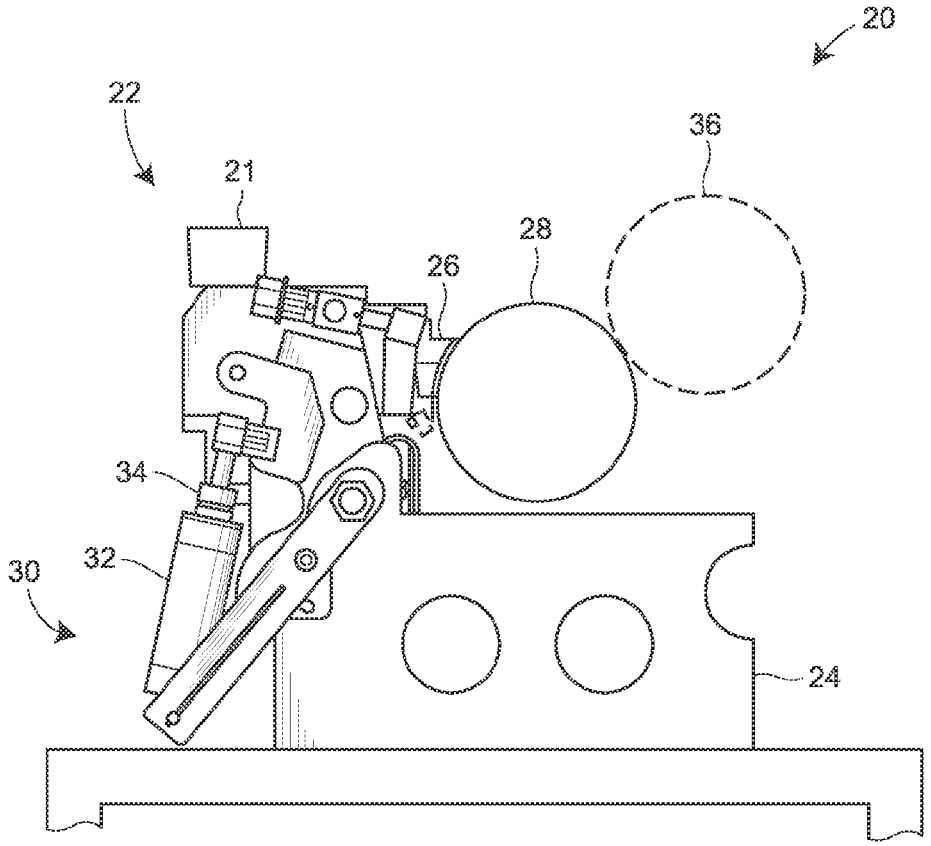
FIG. 2 is a partial elevation view of a printing press having an ink rail assembly constructed in accordance with the teachings of an exemplary form of the present invention.

FIG. 2 illustrates a printing press 20 having a typical ink rail assembly 26 constructed in accordance with the teachings of this disclosure. The printing press 20 can include a plurality of printing units 22, each capable of printing an ink on a common web. For convenience, only one printing unit 22 is depicted in FIG. 2. Each printing unit 22 includes a frame 24, an ink rail assembly 26, and an ink supply drum 28. The printing press 20 with a plurality of the printing units 22 will generally include a number of the ink supply drums 28 and ink rail assemblies 26. The ink rail assembly 26 is shown discussed in detail below with reference to FIGS. 3-6. The ink rail assembly 26 can be rotatably mounted to the frame 24 about a pivot point. The drum 28 can also be rotatably mounted to the frame 24 using any manner known in the art.

The ink rail assembly 26 can be moveable between a work position (shown in FIG. 2), in which the ink rail assembly 26 is adjacent to the transfer drum 28, and a service position (not shown) in which the ink rail assembly 26 is positioned away from the drum 28 and accessible for service. The printing unit 22 can further include an actuator 30 capable of moving the ink rail assembly 26 between the work and service positions. The actuator 30 can be, for example, a hydraulic cylinder 32 that includes a moveable shaft 34. The actuator 30 can also be, for example, an automated jack screw, a pneumatic cylinder, or generally any other mechanism capable of serving the intended purpose.

In operation, ink is supplied to the printing press 20 by an ink source 21 fluidly coupled to the ink rail assembly 26. As used herein, the term "ink" refers to inks and ink emulsions. For example, hoses (not shown) can be used to connect the ink source 21 to the ink rail assembly 26 and define an ink path between the ink source 21 and the ink rail assembly 26. The ink rail assembly 26 delivers ink to the ink supply drum 28, which can then transfer the ink to a series of intermediate rollers and drums 36. Ultimately, the ink is transferred to a plate cylinder (not shown) for printing the ink on a passing web in a manner known in the art.

Figure 3:
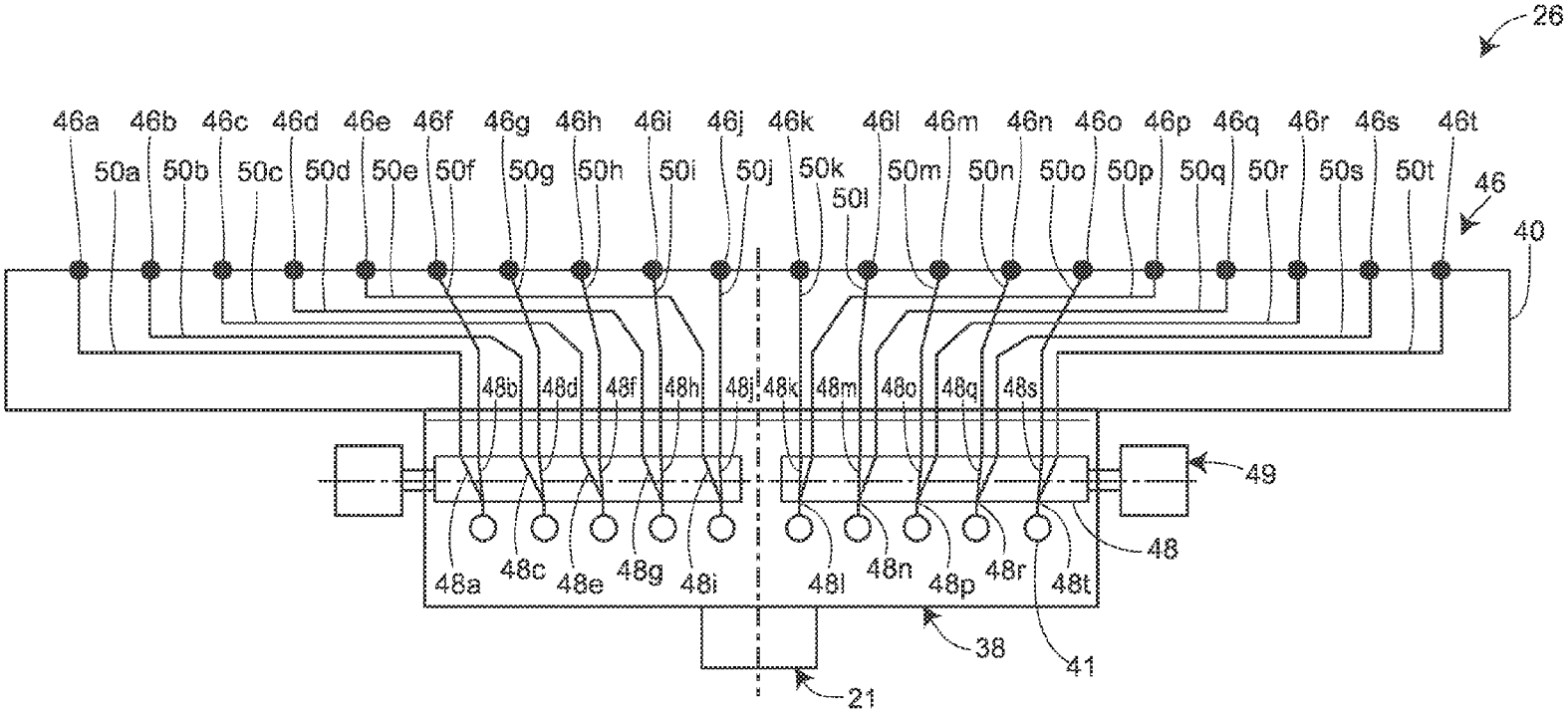
FIG. 3 is a schematic representation of an ink rail assembly constructed in accordance with the first disclosed example of the present invention.
Figure 4:
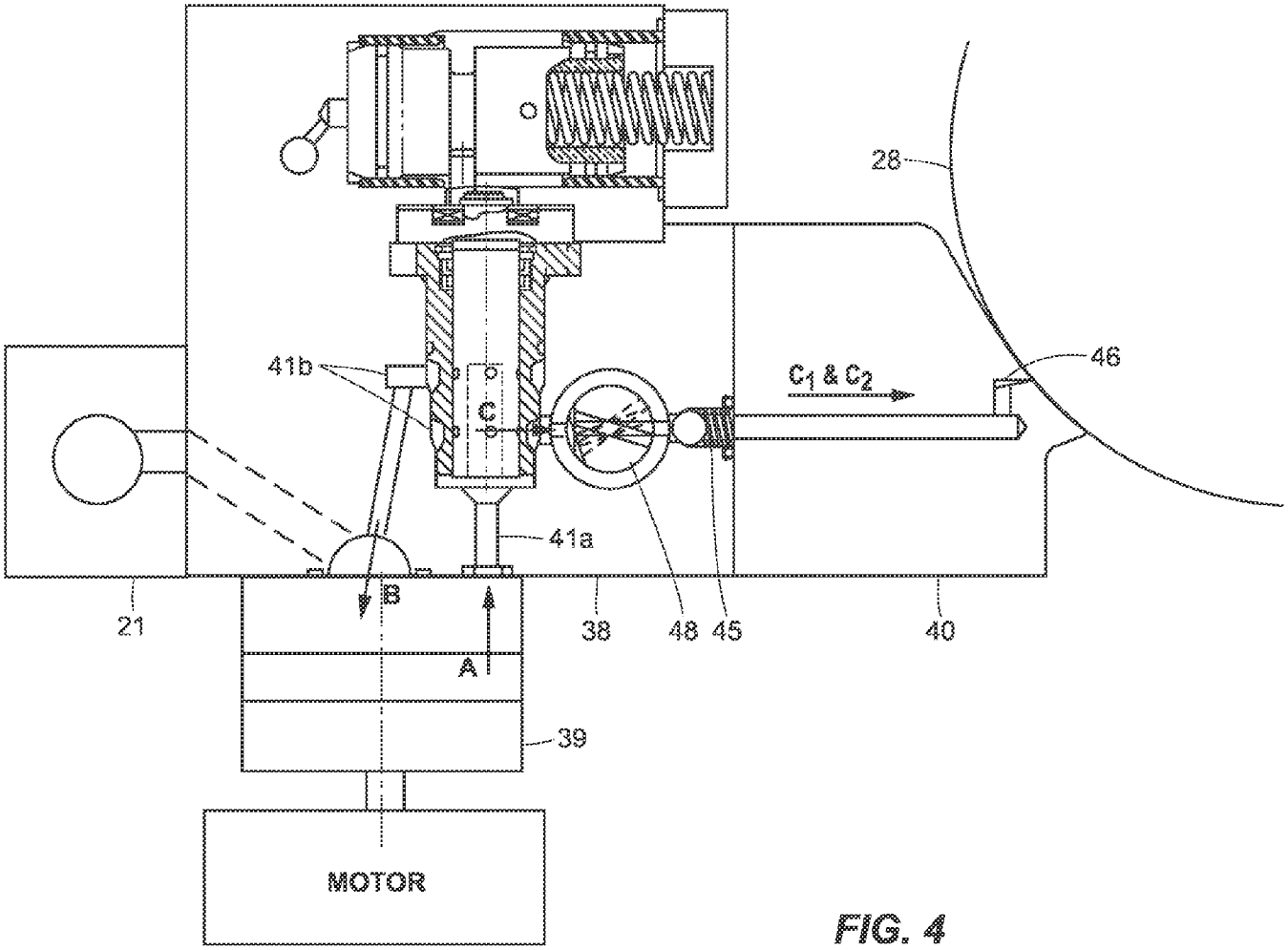
FIG. 4 is an enlarged fragmentary elevation view, partly in section, of the ink rail assembly of FIG. 3.

FIGS. 3 and 4 illustrate the primary embodiment of this invention. The assembly 26 includes a page pack 38 that is mounted in fluid communication with an ink rail 40. Ink from the ink source 21 flows into the page pack 38 and is pumped through the page pack 38 through a diverter assembly 48 and to the ink rail 40. The ink rail 40 is disposed adjacent to the drum 28, as shown in FIG. 2, and delivers the ink onto the drum 28. In other embodiments, the ink rail assembly 26 can include, for example, a plurality of page packs 38 each in fluid communication with a portion of the ink rail 40.

The page pack 38 can include an ink inlet face 42 having one or more ink inlets (not shown) fluidly coupled to an ink source 21. Each individual ink inlet can be connected to a single ink source 21. Alternatively, each of the individual ink inlets can be connected to different ink sources, for example, different colored inks. The page pack 38 can further include a pump/motor (not shown) for pulling the ink from the ink source 21 through the page pack 38 and to the ink rail 40. The page pack 38 can include a plurality of pumps/motors when different ink sources are used to supply different ink inlets. For example, the page pack 38 can include a pump for each ink source 21 used to supply the ink inlets. The pumps can be, for example, gear pumps.

The page pack 38 further includes one or more valves 41 (as shown in FIGS. 3 and 4) that control the flow of ink out of the page pack 38. The number of valves 41 can correspond to the number of page pack 38 ink outlets. Referring to FIG. 4, each valve 41 includes an ink inlet end 41a fluidly coupled to the pumps 39 and an ink outlet end 41*b* fluidly coupled to the page pack 38 ink outlets through check valves 45. The valve 41 is in fluid communication with an ink bypass conduit that returns the ink to the ink source 21 when the valve 41 is in a closed position (preventing ink to flow to the ink rail 40). When in an open position, the valve 41 allows the ink to flow to the ink rail 40. The ink flows through a diverter assembly 48, which directs the valve 41 output pulses into two or more ink keys on the ink rail 40. In operation, the valves 41 can be turned on and off at a controlled pulse rate, which can be, for example, a function of the print density. The check valve 45 can be included to prevent back pressure pulses due to ink compressibility which may affect ink metering accuracy. Any known page pack 38 can be used. For example, the page packs can be of the type described in U.S. Pat. Nos. 5,027,706, 5,472,324, and 7,007,604, the entire disclosures of which are incorporated herein by reference.

The valves in the page pack 38 can be operated, for example, by a unit controller which interfaces with a local area network. See, U.S. Pat. No. 5,027,706. The unit controller can be of the type disclosed in U.S. Pat. No. 4,667,323, the entire disclosure of which is incorporated herein by reference. The unit controller can include a communications process having serial communication channels through which the communications process can receive input messages for transmission on the network. The input messages are distributed to the appropriate serial channel. The serial channels can employ a standard RS protocol. One or more of the serial channels are connected to a processor, which is coupled to sensing and operating devices on the printing unit. For example, the printing unit can include a speed sensing device (not shown). In addition to receiving a press speed feedback signal from the speed sensing device, the processor can produce output signals which control the page pack 38 valves. The processor can also control a variety of other printing unit functions as is known in the art.

Referring back to FIGS. 3 and 4, the ink rail 40 includes an ink key assembly 46. The ink key assembly 46 is shown with twenty ink keys shown, referred to as ink keys 46*a*-46*t*. The ink key assembly 46 is capable of delivering ink to the drum 28.

The ink rail assembly 26 includes a diverter assembly 48. The diverter assembly 48 is in fluid communication with the ink key assembly 46 and the ink outlets of the page pack 38. The diverter assembly can be included as a part of the page pack 38 and/or the ink key assembly 46. Alternatively, the diverter assembly can be an independent unit disposed between the page pack 38 and the ink key assembly 46.

Figure 5:
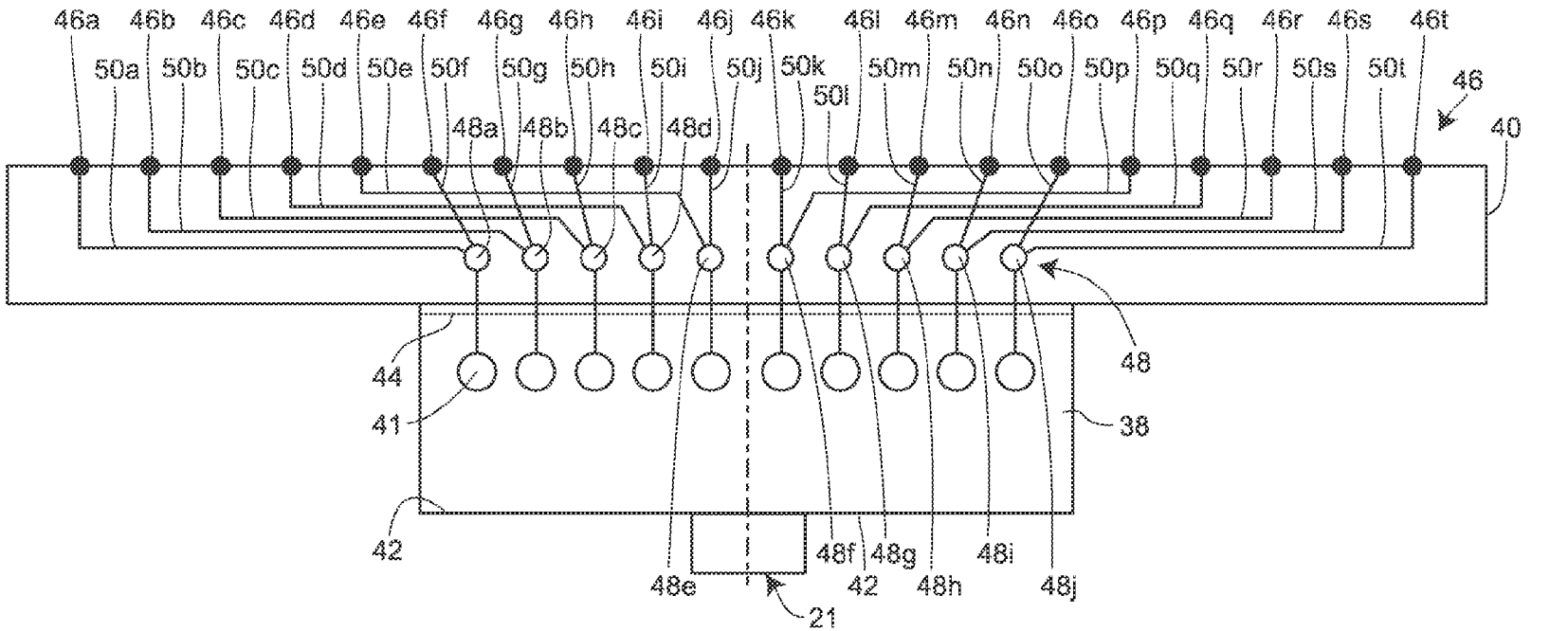
FIG. 5 is a schematic representation of an ink rail assembly construed in accordance with the teachings of a second disclosed example of the present invention and having an ink rail with a diverter spool valve.

As shown in FIG. 3, the diverter assembly 48 can be a diverter rod 48. The diverter rod 48 includes conduits adapted to fluidly couple the page pack ink outlets and the ink keys 46. The diverter rod can include, for example, first and second conduits 48*a*, 48*b* and can be rotatable between a first position in which the first conduit 48*a* is in fluid communication with a page pack ink outlet and a first ink key 46*a* and a second position in which the second conduit is in fluid communication with the page pack ink outlet and a second ink key 46*f*. The diverter rod can include, for example, the same number of conduits as ink keys. A rod actuator can be coupled to the diverter rod to actuate the flow between the at least two ink keys. As shown in FIG. 5, the diverter assembly can include diverter valves that divert the flow between at least two ink keys. The ratio of diverter valves to ink keys can be at least 1:2, such that one diverter valve can selectively deliver ink to at least two ink keys.

The ink rail 40 also includes one or more conduits, with twenty conduits 50*a*-50*t* shown in FIG. 3, each of which defines an ink path between the diverter assembly 48 and an ink keys 46*a*-46*t*. The diverter assembly 48 is operable to divert the flow of ink flowing from a single ink outlet of the page pack 38 to two or more ink keys 46*a*-46*t*, as will be described.

For example, as shown in FIG. 3, the ink rail 40 of the present disclosure includes first through twentieth ink keys 46*a*-46*t*, first through twentieth conduits 50*a*-50*t*, and first through twentieth diverter rod conduits 48*a*-48*t*. By way of example, a first diverter rod inlet 48*a* controls the flow of ink from the page pack 38 to ink keys 46 that are spaced six positions apart, i.e., the first ink key 46*a* and the sixth ink key 46*f*, through first and second diverter rod conduits 48*a*, 48*b*. That is, under one operating condition, the first diverter rod inlet enables ink to flow from the page pack 38 through the first conduit 50*a* and to the first ink key 46*a* to be applied to the drum 28 depicted in FIG. 2, for example. In another operating condition, the diverter rod can be rotated to enable the flow of ink from the page pack 38 through the first diverter rod inlet to the sixth conduit 50*f* and out of the sixth ink key 46*f* to the drum 28. It is foreseeable that any one or more of the diverter rod inlets could enable the flow of ink to the ink keys 46*a*-46*t* associated therewith. Ink flow to each key is thus able to have full and independent control from 0 to 100% of requirement. Accordingly, a single page pack 38 having, for example, ten (10) ink outlets can supply ink to twenty (20) or more ink keys 46. The ratio of page pack ink outlets 38 to ink keys 46 can be 1:2 or more depending on diverter construction. While the present embodiment of the ink rail 40 teaches a diverter assembly 48 serving two ink keys 46 that are spaced six positions removed from each other, alternative embodiments of the ink rail 40 can include diverter assembly 48 serving ink keys 46 positioned any spacing from each other, including adjacent to each other.

The diverter assembly 48 can be constructed of one or multiple parts. Each part can be actuated by a pneumatic or other means for two or more positions. For example, where the diverter assembly 48 is a diverter rod, the rod can be cross drilled to form the diverter conduits. A flat on the rod 48 as shown in FIG. 4 can be included to provide a common chamber for all ink inlet positions. Check valves at ink outlets can be included to prevent back pressure metering disturbances due to ink compressibility.

The ink rail 40 is preferably constructed as a one-piece member, preferably of metal, such that the ink rail 40 is a single, unitary component. Other embodiments, however, can be designed differently. For convenience of ink passage boring as shown diagrammatically in FIG. 3 and FIG. 5, the ink rail can be constructed of convenient segments.

The diverter assembly 48 can be any type of rod or valve capable of controlling ink flow between two or more paths, as described above. For example, the diverter assembly 48 can be a rotary valve, a ball valve, or any other type of valve. In one embodiment, each diverter valve 48 is a diverter spool valve 52 such as that depicted in FIG. 6. For the alternate embodiment of this invention, the diverter spool valve 52 can be, for example, an air actuated three-way valve with a spring return.

Figure 6:
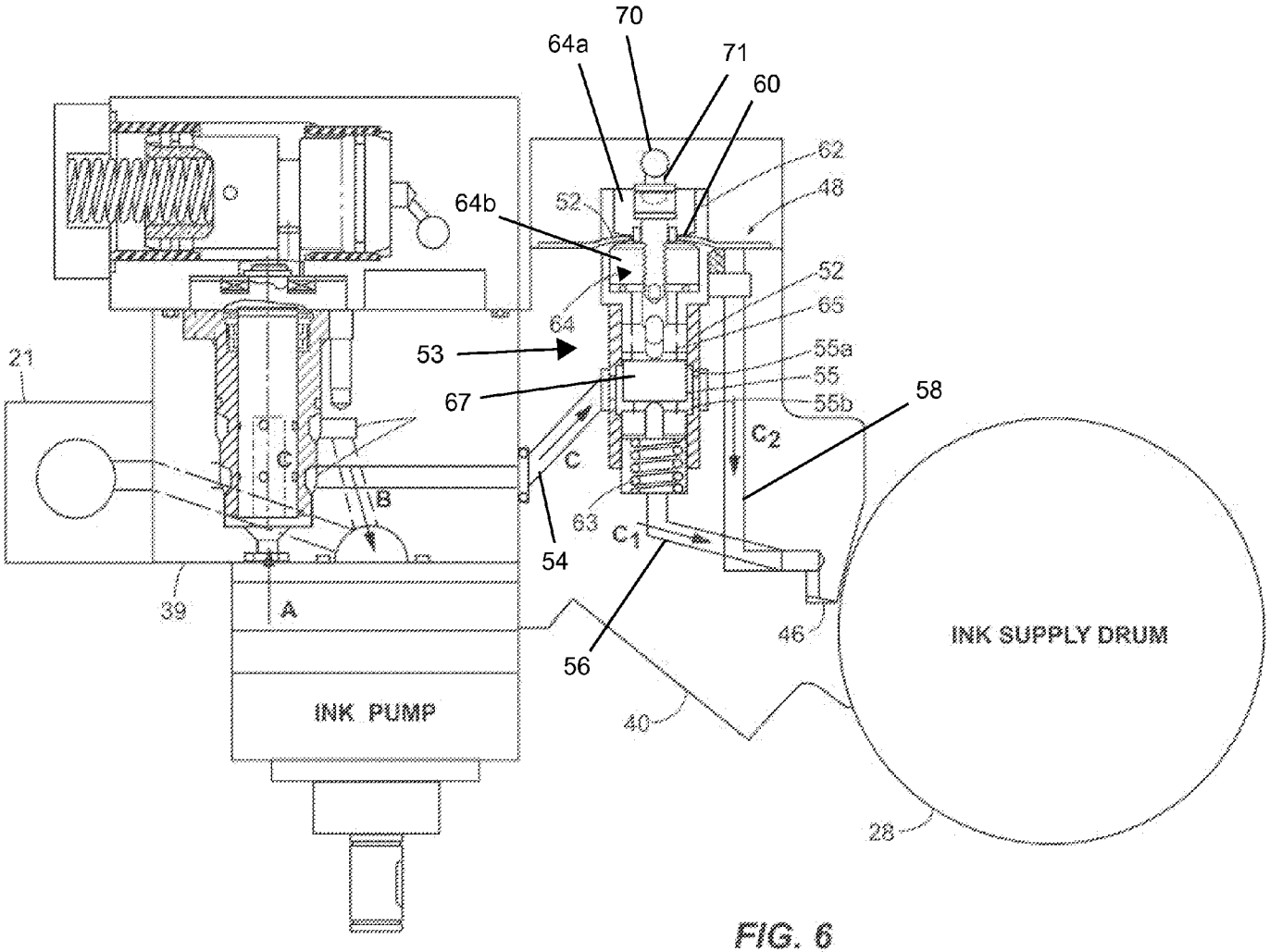
FIG. 6 is an enlarged fragmentary elevation view, partly in section, of the ink rail assembly of FIG. 5.

Specifically, as depicted in FIG. 6, the diverter spool valve 52 can be disposed in a cavity 53 of the ink rail 40, which defines an ink inlet 54, a first ink outlet 56, and a second ink outlet 58. Each ink outlet 56, 58 is fluidly coupled to a separate ink key 46 via a conduit such as one of the conduits 50 described above with respect to FIG. 5. The diverter spool valve 52 depicted in FIG. 5 includes a poppet assembly 64, a diaphragm 60, and a spool 65. The poppet assembly 64 and the diaphragm 60 are disposed in an upper portion 62 of the cavity 53. The spool 65 of the diverter spool valve 52 includes an increased diameter portion 67 that is disposed within a corresponding increased diameter portion 55 of the cavity 53. The poppet assembly 64 and the spool 65 are movable within the cavity 53 for controlling the flow of ink to the outlets 56, 58, as will be described. In one embodiment, a pneumatic supply 70 can be coupled to an inlet 71 formed in the ink rail 40 such that air can be injected into the upper portion 62 of the cavity 53 to selectively move the poppet assembly 64 and the spool 65.

As illustrated, the poppet assembly 64 is coupled to the diaphragm 60 and includes an upper poppet member 64*a* and a lower poppet member 64*b* sandwiching the diaphragm 60. A spring 63 is disposed in the cavity 53 below the spool 65 and biases the spool 65 and the poppet assembly 64 into the position shown in FIG. 5. The spring 63 can be, for example, a coil spring, a wave spring, or any other suitable spring or biasing device. In the absence of pneumatic pressure being applied to the upper portion 62 of the cavity 53 by the pneumatic source 70, the diaphragm 60, the poppet assembly 64, and the spool 65 occupy the position illustrated in FIG. 5.

The position illustrated in FIG. 6 can be referred to as a first open position for the sake of the present description. When in the first open position, the diverter spool valve 52 defines a flow path for ink to travel from the inlet 54 to the first ink outlet 56 and to the ink rail 40. More specifically, as shown, the increased diameter portion 67 of the spool 65 sealingly engages an upper shoulder 55*a* of the increased diameter portion 55 of the cavity 53. This prevents ink from traveling upward to the second ink outlet 58 and allows ink to freely travel through the cavity 53 to the first ink outlet 56.

In order to switch the flow of ink from the first ink outlet 56 to the second ink outlet 58, pneumatic pressure of a first magnitude P1 must be applied from the pneumatic source 70 to the upper chamber 62 to move the diaphragm 60 downward away from first open position depicted in FIG. 6 to a second open position. In the second open position, the increased diameter portion 67 of the spool 65 moves away and disengages from the upper shoulder 55*a* of the increased diameter portion 55 of the cavity 53 and sealingly engages a lower shoulder 55*b* of the increased diameter portion 55 of the cavity 53. This sealing engagement prevents ink from flowing from the inlet 54 to the first ink outlet 56 and allows the ink to flow upward to the second ink outlet 58.

In order to close the spool valve 52 and prevent the flow of ink to both of the first and second outlets 56, 58, the pneumatic source 70 applies a pneumatic pressure of a second magnitude P2 to the upper portion 62 of the cavity 53 that is greater than the first magnitude P1. The second magnitude P2 of pressure forces the poppet assembly 64 and spool 65 further downward such that the lower poppet member 64*b* sealingly engages a lower shoulder 62*a* of the upper portion 62 of the cavity 53. This sealing engagement prevents ink from flowing from the inlet 54 upward to the second ink outlet 58. Meanwhile, continued sealing engagement between the increased diameter portion 67 of the spool 65 and the lower shoulder 55*b* of the increased diameter portion 55 of the cavity 53 prevents the flow of ink to the first outlet 56. To return the valve to the first open position, the pneumatic source simply stops supplying pressure to the upper portion 62 of the cavity 53 so that the spring 63 forces the spool 65 and poppet assembly 64 back to the position depicted in FIG. 6.

Thus, it should be appreciated that the diverter spool valve 52 of the presently disclosed form includes a three-way diverter valve operable between first and second open positions and a closed position. The present invention is not limited to the specific spool valve 52 disclosed herein, but rather, is intended to include generally any type of valve capable of serving the intended purposes.

Figure 7A:
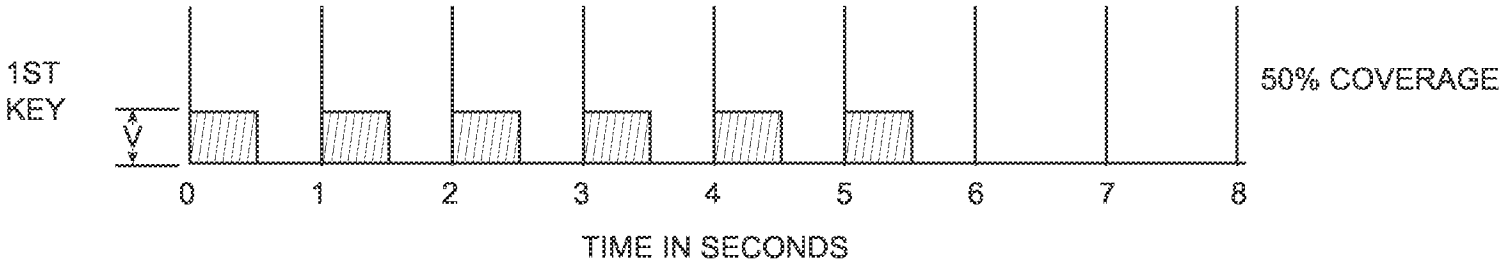
FIG. 7A PRIOR ART
FIG. 7A is a diagrammatic representation of a conventional ink key control process for a conventional ink rail assembly.

Referring to FIG. 7A, in a conventional ink rail assembly 10, a single key is supplied by a single ink outlet of a page pack 38. To obtain 50% ink coverage over a one second period, for example, a valve in a conventional ink rail assembly 10 would open for 0.5 seconds to allow the ink to flow to the drum 28 for that time interval, and would close for 0.5 seconds to prevent the flow of ink. To obtain 25% coverage over a one second period, for example, a valve in a conventional ink rail assembly 10 would open for 0.25 seconds and close for 0.75 seconds.

Figure 7B:
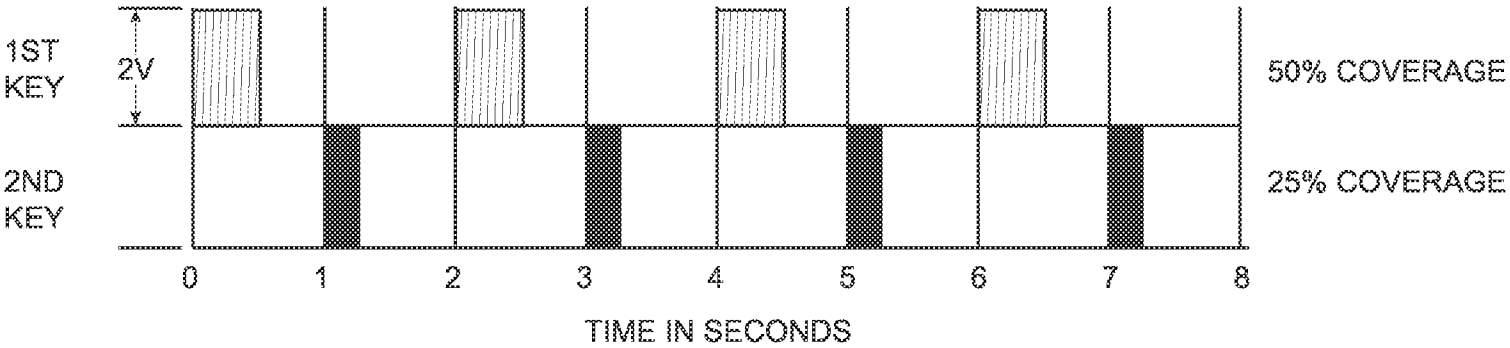
FIG. 7B is a diagrammatic representation of an ink key control process for an ink rail assembly constructed in accordance with the present disclosure.

Referring to FIG. 7B, an ink rail assembly 26 constructed in accordance with the present disclosure can supply two or more ink keys 46 from a single ink outlet on the page pack 38 using a diverter 48 or 52. In the embodiment represented by FIG. 7B, the diverter diverts the supply of ink between two ink keys 46. To obtain 50% coverage for a first key and 25% coverage for a second key, during the first one second interval, the diverter would open towards the first key for 0.5 seconds to allow ink to flow to the first key, but prevent ink from flowing to the second key, and would close for 0.5 seconds to prevent ink from flowing to either key. During the next one second interval, the diverter would open towards the second key for 0.25 seconds to allow ink to flow to the second key, but prevent ink from flowing to the first key, and would close for 0.75 seconds to prevent ink from flowing to either key. The volume of ink supplied during a single period is doubled to compensate for the alternating periods in which ink is supplied to an individual key. In practice the exact timing will be modified to allow for delays in diverter valve actuations and metering valve delays.

Figure 8:
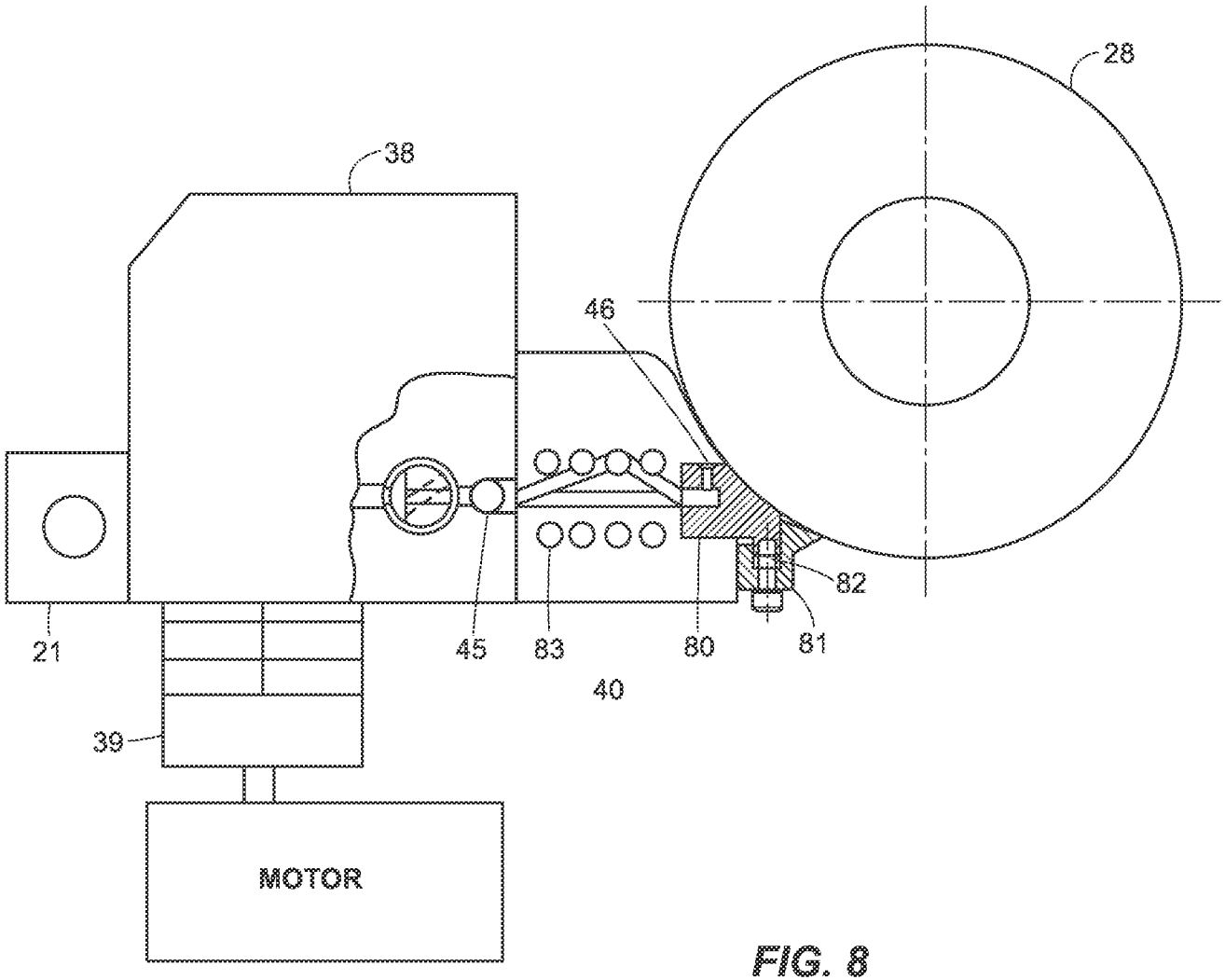
FIG. 8 is an elevation view of an ink rail assembly constructed in accordance with the teachings of an exemplary form of the present invention.

Referring to FIG. 8 the ink rail 40 receives ink from the page pack 38 through a series of check valves 45 and distributes ink laterally inside the ink rail 40 along a number of passages 83 drilled along the ink rail as illustrated diagrammatically in FIG. 3. The ink rail assembly 40 also includes an orifice bar 80 running along the length of the ink rail and terminating in a plurality of orifice scallops 46 which distribute ink along the ink supply drum 28. The orifice bar also comprises an ink leveling bar 81 which is spring loaded in the space 82 and is adjustable as required with a series of adjusting screws.

Figure 9:
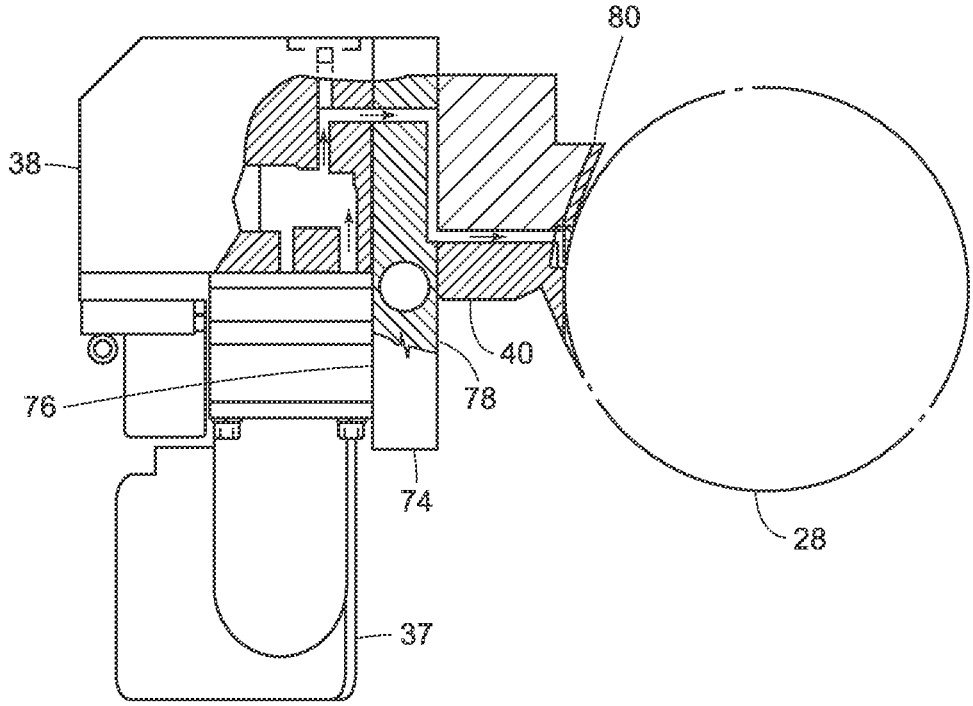
FIG. 9 is an elevation view of an ink rail assembly constructed in accordance with a third disclosed example of the present invention in which an ink rail is connected to a page pack using a manifold.

Referring to FIG. 9, in one embodiment, the ink rail assembly 26 can further include a manifold 74. Suitable manifolds 74 are generally known in the art. See U.S. Pat. No. 7,007,604. The manifold 74 can operatively couple the page pack 38 and the ink rail 40. Additionally, the manifold 74 can be mounted to the frame 24 of the printing press 20 to aid in mounting the ink rail assembly 26 to the printing press 20. The manifold 74 can be rotatably mounted to the frame 24 of the printing press 20. For example, the manifold 74 can include threaded holes for mounting the manifold 74 to the frame 24 of the printing unit 22.

The manifold 74 includes an ink inlet face 76 and an ink outlet face 78. The page pack 38 is coupled to the ink inlet face 76 of the manifold 74, and the ink rail 40 is coupled to the ink outlet face 78 of the manifold 74 using any known methods. The page pack 38, ink rail 40, and manifold 74 are in fluid communication. For example, one or more manifold 74 ink inlets (not shown) can be disposed on the ink inlet face 76 in fluid communication with the page pack 38 ink outlets, and one or more manifold 74 ink outlets (not shown) can disposed on the ink outlet face 78 in fluid communication with a diverter valve 48 inlet. Ink is, therefore, supplied from the ink source 21 through the page pack 38, through the manifold 74, and to the ink rail 40 to be delivered to the drum 28 by the ink keys 46.

An orifice plate 80 can be further included in a printing press 20 having an ink rail assembly 26 in accordance with the present disclosure. The orifice plate 80 can be removably attached to the ink rail 40, and can be disposed adjacent the drum 28. The orifice plate 80 includes at least two ink inlets in fluid communication with at least two ink outlets (not shown). The orifice plate 80 ink inlets are in fluid communication with the ink keys 46 to receive ink from the ink keys 46. The ink travels through an ink path within the orifice plate 80 to the orifice plate 80 ink outlets. The orifice plate 80 ink outlets are disposed adjacent to the drum 28 and transfer the ink to the drum 28.

The preceding text sets forth a detailed description of numerous different embodiments of the invention. It should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed:

1. An ink rail assembly, comprising:

a page pack including a page pack ink inlet in fluid communication with an ink source and a page pack ink outlet in fluid communication with the page pack ink inlet;

an ink rail comprising at least two ink keys fluidly coupled to the page pack ink outlet; and a diverter assembly in fluid communication with the page pack ink outlet and the at least two keys;

a pump fluidly connected to the diverter assembly, the pump being configured to pull ink form the ink source and to send ink to the diverter assembly, wherein the diverter assembly selectively diverts the flow of ink from the page pack ink outlet between the at least two ink keys, and wherein the pump is configured to output 200% of the ink required by one of the ink keys.

2. The ink rail assembly of claim 1, wherein the diverter assembly comprises first and second conduits and is adapted to shift between a first position in which the first conduit fluidly couples the page pack ink outlet and one of the at least two ink keys and a second position in which the second conduit fluidly couples the page pack ink outlet and the other one of the at least two ink keys to selectively divert the flow of ink from the page pack ink outlet between the at least two ink keys.

3. The ink rail assembly of claim 1, wherein the diverter assembly comprises a diverter valve to selectively divert the flow of ink from the page pack ink outlet between the at least two keys.

4. The ink rail assembly of claim 3, wherein the page pack comprises a plurality of page pack ink outlets and the diverter assembly comprises a plurality of diverter valves, and the ratio of diverter valves to page pack ink outlets is 1:1.

5. The ink rail assembly of claim 4, wherein a ratio of ink keys to diverter valves is at least 2:1.

6. The ink rail assembly of claim 3, wherein the diverter valve fully and independently controls ink flow to each of the at least two ink keys.

7. The ink rail assembly of claim 1, wherein the diverter assembly includes a plurality of diverter valves, each diverter valve being fluidly connected to two ink keys.

8. The ink rail assembly of claim 1, wherein the pump is a gear pump.

9. The ink rail assembly of claim 1, wherein the diverter is actuated at time intervals of 1 second or less.

10. The ink rail assembly of claim 1, further comprising a controller operatively connected to the diverter assembly, the controller actuating the diverter assembly at time intervals of 1 second or less.

11. The ink rail assembly of claim 10, further comprising a speed sensing device that senses a printing speed, the speed sensing device being communicatively connected to the controller.

12. A printing press, comprising:

a frame;

a drum mounted to the frame for receiving and transferring ink;

an ink rail assembly configured to deliver ink to the drum, the ink rail assembly comprising:

a page pack including a page pack ink inlet in fluid communication with an ink source and a page pack ink outlet in fluid communication with the page pack ink inlet;

an ink rail comprising at least two ink keys fluidly coupled to the page pack ink outlet;

a diverter assembly in fluid communication with the page pack ink outlet and the at least two keys;

a pump fluidly connected to the diverter assembly, the pump being configured to pull ink from an ink source and to send ink to the diverter assembly; and a controller operatively connected to the diverter assembly, the controller being configured to actuate the diverter assembly at intervals of 1 second or less to modulate ink flow between the at least two ink keys, wherein the diverter assembly selectively diverts the flow of ink from the page pack ink outlet between the at least two ink keys.

13. The printing press of claim 12, wherein the diverter assembly comprises first and second conduits and is adapted to shift between a first position in which the first conduit fluidly couples the page pack ink outlet and one of the at least two ink keys and a second position in which the second conduit fluidly couples the page pack ink outlet and the other one of the at least two ink keys to selectively divert the flow of ink from the page pack ink outlet between the at least two ink keys.

14. The printing press of claim 13, wherein the page pack comprises a plurality of page pack ink outlets and the diverter assembly comprises a plurality of conduits, the ratio of page pack ink outlets to conduits is at least 1:2, and the ratio of ink keys to conduits is 1:1.

15. The printing press of claim 12, wherein the diverter assembly comprises a diverter valve to selectively divert the flow of ink from the page pack ink outlet between the at least two keys.

16. The printing press of claim 15, wherein the page pack comprises a plurality of page pack ink outlets and the diverter assembly comprises a plurality of diverter valves, and the ratio of diverter valves to page pack ink outlets is 1:1.

17. The printing press of claim 16, wherein a ratio of ink keys to diverter valves is at least 2:1.

18. The ink rail assembly of claim 15, wherein the diverter valve fully and independently controls ink flow to each of the at least two ink keys.

19. The ink rail assembly of claim 12, wherein the diverter includes a plurality of diverter valves, each diverter valve being fluidly connected to two ink keys.

20. The ink rail assembly of claim 12, wherein the pump is a gear pump.

21. The ink rail assembly of claim 12, further comprising a speed sensing device that senses a printing speed, the speed sensing device being communicatively connected to the controller.

22. The ink rail assembly of claim 12, wherein the pump is configured to output 200% of the ink required by one key.

23. A printing press comprising:

a frame;

a drum mounted to the frame for receiving and transferring ink; and an ink rail assembly configured to deliver ink to the drum, the ink rail assembly comprising:

a page pack including a page pack ink inlet in fluid communication with an ink source and a page pack ink outlet in fluid communication with the page pack ink inlet;

an ink rail comprising at least two ink keys fluidly coupled to the page pack ink outlet; and a diverter assembly in fluid communication with the page pack ink outlet and the at least two keys, wherein the diverter assembly selectively diverts the flow of ink from the page pack ink outlet between the at least two ink keys, wherein the at least two ink keys are separated by at least four other ink keys.

* * * * *

UNITED STATES PATENT AND TRADEMARK OFFICE

CERTIFICATE OF CORRECTION

PATENT NO. : 8,950,325 B2
APPLICATION NO. : 12/855248
DATED : February 10, 2015
INVENTOR(S) : Thaddeus A. Niemiro et al.

It is certified that error appears in the above-identified patent and that said Letters Patent is hereby corrected as shown below:

Title page, item (75), line 4, "Lemo" should be -- Lemont --.

In the claims

At Column 9, line 31, "two keys." should be -- two ink keys. --.

At Column 10, line 30, "two keys." should be -- two ink keys. --.

Signed and Sealed this
Fifth Day of January, 2016

Michelle K. Lee

Michelle K. Lee
*Director of the United States Patent and Trademark Office*